United States Patent [19]

Timberlake et al.

[11] 4,132,443

[45] Jan. 2, 1979

[54] METHOD AND APPARATUS SUITABLE FOR GRIPPING AN ANNULAR WORKPIECE

[75] Inventors: Cecil H. Timberlake, Oakton, Va.; Willie E. Viverette, Jr., Houston, Tex.; John B. Davidson, Bartlesville, Okla.

[73] Assignee: Phillips Petroleum Company, Bartlesville, Okla.

[21] Appl. No.: 782,690

[22] Filed: Mar. 30, 1977

[51] Int. Cl.[2] ..... B25B 9/00

[52] U.S. Cl. ..... 294/97; 294/16

[58] Field of Search ..... 294/97, 103 CG, 106, 294/119, 62, 117, 16; 242/72; 57/52

[56] References Cited

U.S. PATENT DOCUMENTS

| | | | |
|---|---|---|---|
| 258,203 | 5/1882 | Palm | 294/16 |
| 296,559 | 4/1884 | Hardin | 294/16 |
| 1,252,226 | 1/1918 | Bonk et al. | 294/97 |
| 2,794,669 | 6/1957 | Schardinger | 294/97 |
| 3,462,934 | 8/1969 | Schulze | 57/52 |

*Primary Examiner*—James B. Marbert

[57] ABSTRACT

An annular workpiece is grasped by inserting into an annular portion of the annular workpiece the second end of a gripping member having a first end and an expandable second end and expanding the expandable end of the gripping member.

7 Claims, 3 Drawing Figures

METHOD AND APPARATUS SUITABLE FOR GRIPPING AN ANNULAR WORKPIECE

BACKGROUND OF THE INVENTION

The invention relates to a method and apparatus for grasping an annular workpiece. In another aspect the invention relates to a method and apparatus suitable for grasping and repositioning packages of yarn. In another aspect the invention relates to a method and apparatus suitable for use by a workman for moving an annular workpiece wihout touching the workpiece with his hands.

Frequently it is desirable to move a workpiece, such as a package of yarn, by a workman without his hands touching the workpiece. For example, some packages of yarn are easily damaged when a workman picks them up with his hands if he is not particularly careful. Further, if the workman does not use gloves, oil deposited on the yarn from the workman's hands can adversely affect the yarn, such as by impairing the processability of a freshly spun yarn. Thus it is desirable to handle an annular workpiece, such as a package of freshly spun yarn, without the necessity of the workman actually touching the workpiece with his hands.

An object of the invention is to grasp an annular workpiece by a workman without the need for the workman to touch the workpiece with his hands.

Another object of the invention is to provide an improved apparatus suitable for carrying out the above object.

Other objects, aspects and advantages of the present invention will be apparent to those skilled in the art upon studying the specification, drawings and the appended claims.

SUMMARY OF THE INVENTION

In accordance with the invention apparatus comprises a gripping member having a first portion, a second portion, a first end and a second end, the first portion and the second portion are hinged together so that the second end of the gripping member is expandable, and a first means and a second means for holding the apparatus wherein the first means is attached to the first end of the first portion of the gripping member and the second means is attached to the first end of the second portion of the gripping member so that when the first means and the second means are forced closer together the second end of the gripping member is expanded.

Further according to the invention, an annular workpiece is grasped by inserting the second end of the gripping member having a first end and an expandable second end into an annular portion of an annular workpiece, the gripping member comprising at least a first portion and a second portion which are hinged together at the first end, and expanding the expandable end of the gripping member by forcing the first and second portions apart at the second end so that the annular workpiece is grasped. The above-described apparatus and method provide an efficient and readily acceptable alternative for repositioning an annular workpiece, such as a freshly spun package of yarn, without the necessity of a workman touching the workpiece with his hands.

DETAILED DESCRIPTION OF THE INVENTION

Figure 1:
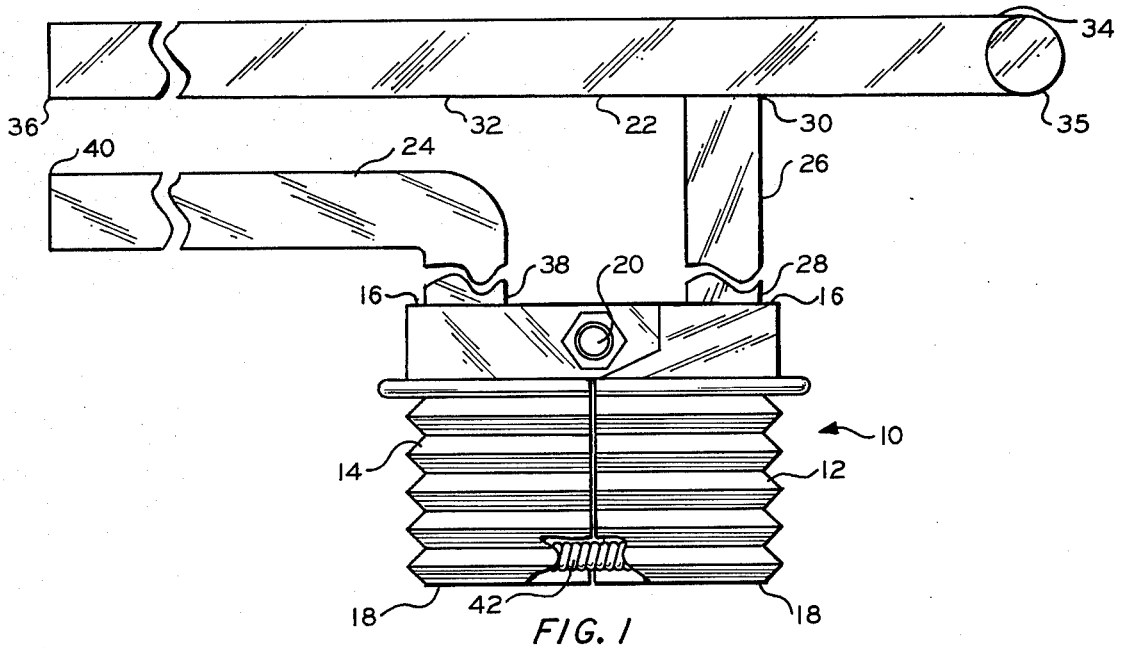
FIG. 1 is an elevation of one embodiment of an apparatus in accordance with the invention.

Referring to FIG. 1 the apparatus of the invention comprises gripping member indicated generally by reference numeral 10 having a first portion 12, a second portion 14, a first end 16 and a second end 18. The first and second portions are attached at the first end by hinge 20. A handle is provided for holding the apparatus comprising a first means 22 and a second means 24. The first means comprises a first member 26 having a first end 28 attached to the first end 16 of the first portion 12 of the gripping member 10 and a second end 30 attached to a second member 32 as shown in the drawing. The second member has a first end 34 and a second end 36. The first end 34 is attached to cross member 35. The second end 36 of the second member 32 extends a distance in a direction toward the second portion 14 of the gripping member 10. The second means 24 for holding the apparatus comprises an elongated member having a first end 38 attached to the second end 16 of the second portion 14 of the gripping member 10 and a second end 40 extending a distance away from the first portion 12 of the gripping member 10 and essentially parallel to and under the second end 36 of the second member 32 of the first means 22. The first means 22 and the second means 24 are close enough together that a workman can grip first means 22 and second means 24 near ends 36 and 40, respectively, with one hand.

Figure 2:
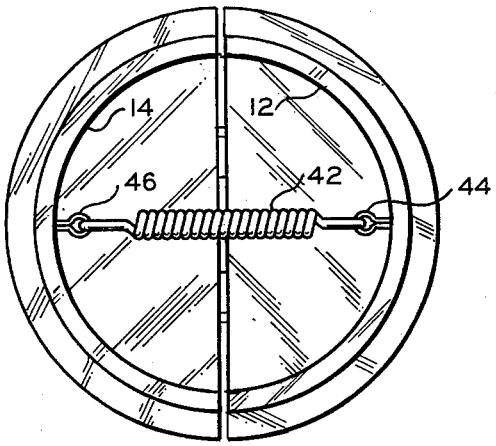
FIG. 2 is a bottom view of the second end gripping member of FIG. 1.
Figure 3:
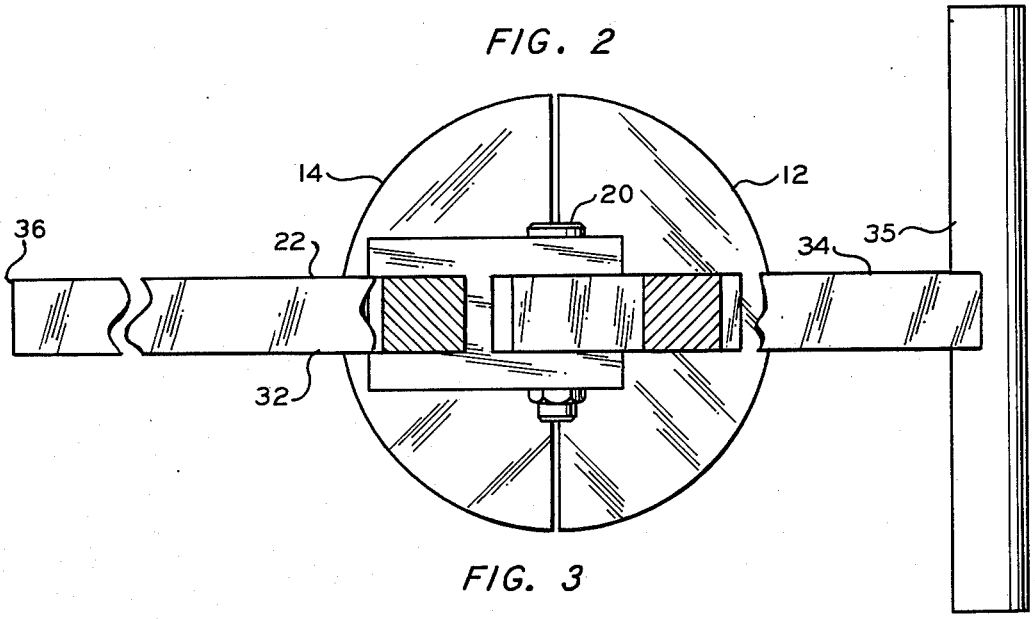
FIG. 3 is a plan view of the apparatus of FIG. 1.

Further the apparatus comprises a means for contracting the second end 18 of the gripping member 10 when the second end is expanded which in this particular embodiment comprises a spring 42 shown more clearly in FIG. 2 which has one end 44 attached to the first portion 12 of the gripping member 10 and another end 46 attached to the second portion 14 of gripping member 10. As indicated in FIG. 1 spring 42 is preferably positioned close to second end 18 of gripping member 10. Further gripping member 10 is cylindrical in shape and thus the first portion 12 and the second portion 14 of gripping member 10 are semicylindrical; however, most any shape could be employed as long as one end can be inserted into an annular workpiece. Although it is not essential, it is desirable that the outside surfaces of the semicylindrical portions 12 and 14 be corrugated with the grooves lying in a plane parallel to the radius of gripping member 10.

In the operation of the apparatus a workman grasps with one hand first means 22 and second means 24 near ends 36 and 40. By forcing ends 36 and 40 closer together second end 18 of gripping member 10 is expanded which then grasps an annular workpiece through which the second end 18 of gripping member 10 has been inserted into prior to expanding the second end. If desirable or necessary, the workman can place his other hand on the cross member 35 attached to first end 34 of holding means 22 to provide better stability and enable the workman to use greater force in repositioning the annular workpiece. Spring 42 is in the stretched position when second end 18 of gripping member 10 is expanded, thus when the workman releases ends 36 and 40, the second end 18 of gripping member 10 is contracted by the action of spring 42, releasing the annular workpiece.

EXAMPLE

In a specific example, an apparatus was constructed according to the invention essentially as shown in the drawings using 304 stainless steel as the construction material. The first and second portions of the gripping member, which combined to make the gripping surface, had an inside diameter of 2.0" (4.08 cm), an outside major diameter of 2.50" (6.35 cm), a corrugated outside surface having five gripping ridges. A split flange 2.875" diameter (7.30 cm) by 0.125" thick (0.317 cm) was welded to the top of the gripping member. A coil spring was attached to the inside surface of the gripper portions at about 0.375" (0.949 cm) from the bottom end to urge the two halves together as shown in the drawings. A U-shaped clevis was welded to the top of one-half of the flange and extended outward over the center line 0.3750" (0.952 cm) and had a 0.250" (0.635 cm) diameter hole drilled in each wall and in alignment with the center line of the apparatus. The walls of the U-shaped clevis were 0.510" (1.295 cm) apart. A handle having a 0.50" (1.27 cm) square cross section was welded to the top of the U-shaped clevis with its center line extending 0.625" (1.587 cm) from one edge of the flange and positioned on the center line of the apparatus in the other direction. The handle extended upward so that its center line was 1.50" (3.810 cm) from the face of the split flange, then 90° outward along the center line of the apparatus away from the other half of the gripping member. The handle extended outward 5.625" (14.287 cm) from its center line. The matching portion of the clevis was welded to the top of the flange on the opposite half of the gripper portion along the center line and was 0.500" (1.27 cm) wide with a matching hole along the center line of the apparatus to accommodate a 0.250" (0.635 cm) diameter shoulder bolt for holding the two portions together. The matching clevis was 0.50" (1.27 cm) high and had a handle having a square cross-section of 0.50" (1.27 cm) welded to the top of the clevis so that its center line was 0.562" (1.427 cm) from the edge of the flange. The handle extended upward from the top of the flange 3.0" (7.62 cm) to its center line and had a second bar of the same cross-section welded to its top surface and extending 7.250" (18.415 cm) from the center line of the handle in a direction placing it directly over the bent portion of the handle of the gripper portion described above. The handle also extended in the opposite direction 2.250" (5.715 cm) from its center line to the center line of a round member welded at right angles and in a plane parallel with the flange. The round member was 0.500" (1.27 cm) in diameter and 4.0" (10.160 cm) long. The apparatus was used to grasp annular workpieces, specifically yarn packages having a package support with an inside diameter of 2.52" (6.4 cm). The apparatus easily grasped the packages and easily released them by operating the two handles without the necessity of the operator's hands touching the yarn. Further the operators were quick to accept the invention for handling the packages of yarn which evidences the invention's simplicity of operation.

That which is claimed is:

1. Apparatus comprising:

a gripping member having a first portion, a second portion, a first end and a second end, said first portion and said second portion are hinged together so that the second end of said gripping member is expandable, a first means and a second means for holding the apparatus wherein said first means is attached to the first end of the first portion of said gripping member and said second means is attached to the first end of the second portion of said gripping member so that when said first means and said second means are forced closer together the second end of the gripping member is expanded, and wherein the first means for holding the apparatus comprises a first member having a first end and a second end wherein said first end is attached to the first end of the first portion of said gripping member and extends a distance outward from said first portion in a plane normal to the direction of expansion of said gripping member, a second member having a first end and a second end, wherein said second member is attached to the second end of said first member between the first end and the second end of said second member wherein the second end of said second member extends a distance in a direction parallel to the direction of expansion of said gripping member and toward the second portion of said gripping member, and the first end of the second member extends a distance in a direction opposite to the second end of the second member and has a third member attached near the first end of the second member in a position essentially perpendicular thereto to form a "T"-shaped handle, and wherein the second means for holding the apparatus comprises an elongated member having a first end and a second end wherein the first end is attached to the first end of said second portion, and wherein said second end extends a distance away from the first portion of said gripping member and essentially parallel to and under the second end of the second member of the first means.

2. The apparatus of claim 1 further comprising a means for contracting the second end of said gripping member when said second end is expanded.

3. The apparatus of claim 2 wherein said contracting means comprises a spring having a first end and a second end wherein said first end is attached to the first portion of said gripping member and said second end is attached to the second portion of said gripping member.

4. The apparatus of claim 1 wherein said first portion and said second portion of said gripping member are each essentially semicylindrical.

5. The apparatus of claim 1 wherein the gripping member has an outer surface which is corrugated with the grooves being parallel to the radius of the gripping member.

6. A method for grasping a package of yarn having a package support employing an apparatus according to claim 1 comprising:

inserting the second end of the gripping member into the package support of the package of yarn, forcing said first and second portions apart at said second end by grasping and forcing said first means and said second means closer together so that said package support is grasped and grasping the "T"-shaped handle to provide stability when moving said package of yarn with said apparatus.

7. The method of claim 6 wherein the yarn is as spun yarn.

* * * * *